US007293966B2

(12) United States Patent
Cho et al.

(10) Patent No.: US 7,293,966 B2
(45) Date of Patent: Nov. 13, 2007

(54) VARIABLE CAPACITY ROTARY COMPRESSOR

(75) Inventors: Sung-Hea Cho, Suwon (KR); Seung-Kap Lee, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 637 days.

(21) Appl. No.: 10/648,244

(22) Filed: Aug. 27, 2003

(65) Prior Publication Data

US 2004/0175274 A1 Sep. 9, 2004

(30) Foreign Application Priority Data

Mar. 6, 2003 (KR) ..... 10-2003-0014125

(51) Int. Cl.
*F04B 49/00* (2006.01)

(52) U.S. Cl. ..... 417/410.3; 417/218; 417/221; 417/212

(58) Field of Classification Search ..... 417/212, 417/315, 441, 410.3, 223, 218, 221, 215; 137/119.01, 119.08, 119.09, 907
See application file for complete search history.

(56) References Cited

U.S. PATENT DOCUMENTS 4,780,067 A * 10/1988 Suzuki et al. ..... 417/441

FOREIGN PATENT DOCUMENTS

JP 2002-266772 9/2002

JP 2004-132349 4/2004

OTHER PUBLICATIONS

Patent Abstracts of Japan for Japanese Publication No. 2001-280253, published Oct. 10, 2001.
Patent Abstracts of Japan for Japanese Publication No. 02-140477, published May 30, 1990.
Japanese Office Action for Application No. 2003-374901, dated Nov. 28, 2006.

* cited by examiner

*Primary Examiner*—Anthony D Stashick
*Assistant Examiner*—Jessica L Frantz
(74) *Attorney, Agent, or Firm*—Staas & Halsey LLP

(57) ABSTRACT

A variable capacity rotary compressor including a housing, the housing including two compression chambers, the two compression chambers having different capacities; a rotating shaft rotatably provided in the two compression chambers; two eccentric units respectively provided in the compression chambers in such a way as to be fitted over the rotating shaft, the two eccentric units being operated so that one of the two eccentric units is positioned eccentrically from the rotating shaft to perform a compression operation while the other eccentric unit is positioned concentrically with the rotating shaft to perform an idle operation, according to a rotating direction of the rotating shaft; roller pistons fitted over each of the two eccentric units; vanes installed in each of the two compression chambers so as to reciprocate in a radial direction while being in contact with an outer surface of the roller piston; and a path control unit to control a refrigerant suction path so that a refrigeran is provided to an inlet port of one of the two compression chambers which performs the compression operation.

12 Claims, 10 Drawing Sheets

VARIABLE CAPACITY ROTARY COMPRESSOR

CROSS-REFERENCE TO RELATED APPLICATIONS

This application claims the benefit of Korean Application No. 2003-14125, filed Mar. 6, 2003, in the Korean Intellectual Property Office, the disclosure of which is incorporated herein by reference.

BACKGROUND OF THE INVENTION

1. Field of the Invention

The present invention relates, in general, to rotary compressors, and, more particularly, to a variable capacity rotary compressor which is capable of varying the compression capacity of the compressor as desired.

2. Description of the Related Art

Recently, a variable capacity compressor has been increasingly used in a variety of refrigeration systems, such as air conditioners or refrigerators, so as to vary a cooling capacity as desired, thus accomplishing an optimum cooling operation and a saving of energy.

An earlier patent disclosure dealing with a variable capacity compressor is found in U.S. Pat. No. 4,397,618. According to the patent, a rotary compressor is designed to vary a compression capacity thereof by holding or releasing a vane. The rotary compressor includes a casing in which a cylindrical compression chamber is provided. A rolling piston is installed in the compression chamber of the casing to be eccentrically rotated. Further, a vane, designated as a "slide" in U.S. Pat. No. 4,397,618, is installed in the casing, and reciprocates in a radial direction while being in contact with an outer surface of the rolling piston. A vane holding unit, which includes a ratchet bolt, an armature, and a solenoid, is provided at a side of the vane to hold or release the vane, thus varying the compression capacity of the rotary compressor. That is, the vane is held or released in response to a reciprocating movement of the ratchet bolt controlled by the solenoid, thus varying the compression capacity of the rotary compressor.

However, the conventional variable capacity rotary compressor has a problem in that it is designed such that the compression operation thereof is controlled by holding or releasing the vane for a predetermined period of time, so it is difficult to precisely vary the compression capacity to obtain a desired exhaust pressure.

Further, the conventional variable capacity rotary compressor has another problem in that the ratchet bolt holding the vane is designed to enter a side of the vane and be locked to a locking hole formed at the vane, so it is not easy to hold the vane which reciprocates at a high speed when the compressor is operated, thus having poor reliability.

SUMMARY OF THE INVENTION

Accordingly, it is an aspect of the present invention to provide a variable capacity rotary compressor, which is designed to precisely vary a compression capacity to obtain a desired exhaust pressure, and to easily control an operation of varying the compression capacity.

Additional aspects and advantages of the invention will be set forth in part in the description which follows and, in part, will be obvious from the description, or may be learned by practice of the invention.

The foregoing and/or other aspects of the present invention are achieved by providing a variable capacity rotary compressor, including a housing, a rotating shaft, two eccentric units, a roller piston, a vane, and a path control unit. The housing includes two compression chambers having different capacities. The rotating shaft is rotatably provided in the two compression chambers. The two eccentric units are respectively provided in the compression chambers in such a way as to be fitted over the rotating shaft, and are operated so that one of the two eccentric units is positioned eccentrically from the rotating shaft to perform a compression operation while the other eccentric unit is positioned concentrically with the rotating shaft to perform an idle operation, according to a rotating direction of the rotating shaft. The roller pistons are fitted over each of the two eccentric units. The vanes are installed in each of the two compression chambers so as to reciprocate in a radial direction while being in contact with an outer surface of the roller piston. The path control unit controls a refrigerant suction path so that a refrigerant is sucked into an inlet port of one of the two compression chambers which performs the compression operation.

The path control unit includes a hollow body, an inlet, first and second outlets, a valve seat, and first and second valve units. The hollow body has a predetermined length, and is closed at both ends thereof. The inlet is formed at a central portion of the hollow body, and is connected to a refrigerant inlet pipe. The first and second outlets are formed on the hollow body at opposite sides of the inlet, and are connected to the inlet ports of the two compression chambers via pipes. The valve seat is provided in the hollow body so as to form a decrease in the cross-sectional area of the hollow body. The valve seat has an opening on a sidewall thereof to allow an interior space thereof to communicate with the inlet, and is opened at both ends thereof to communicate with the outlets. The first and second valve units are respectively provided at each end of the valve seat.

The valve seat may have a length shorter than a distance between the two outlets, and may be fitted into the hollow body so that the opening formed on the sidewall of the valve seat communicates with the inlet of the path control unit.

The first and second valve units may be connected to each other so as to be moved together, axially reciprocating in the hollow body to open or close each end of the valve seat.

Each of the first and second valve units may include a thin valve plate able to come into contact with the valve seat.

Each of the first and second valve units may include a support member to movably support the valve plate in the hollow body.

Each support member may have an outer diameter corresponding to an inner diameter of the hollow body so as to smoothly reciprocate in the body.

A plurality of holes may be formed on the support member.

The first and second valve units may move in a direction toward one of the two outlets having a lower pressure due to a difference in pressure between the two outlets, thus closing one of the both ends of the valve seat so that the inlet communicates with the outlet having the lower pressure.

The connecting member may comprise two parts. The two parts of the connecting member may be connected to each other by an elastic member to absorb shock or vibration generated during operation of the compressor.

The elastic member may be made of a rubber having elasticity.

Each of the two eccentric units may include an eccentric cam fitted over the rotating shaft, an eccentric bush rotatably fitted over the eccentric cam, with the roller piston fitted over the eccentric bush, and a locking unit to fix the eccentric bush at a position where an outer surface of the eccentric bush is positioned eccentrically from the rotating shaft or at a position where the outer surface of the eccentric bush is positioned concentrically with the rotating shaft.

The locking units may include a first locking part projected from the rotating shaft or the eccentric cam, and a second locking part projected from a surface of the eccentric bush to contact the first locking part.

The locking units may be arranged in opposite directions, so that when one of the eccentric units is positioned eccentrically from the rotating shaft by a rotation of the rotating shaft, the other eccentric unit is positioned concentrically with the rotating shaft.

The vanes may be biased by an elastic member.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
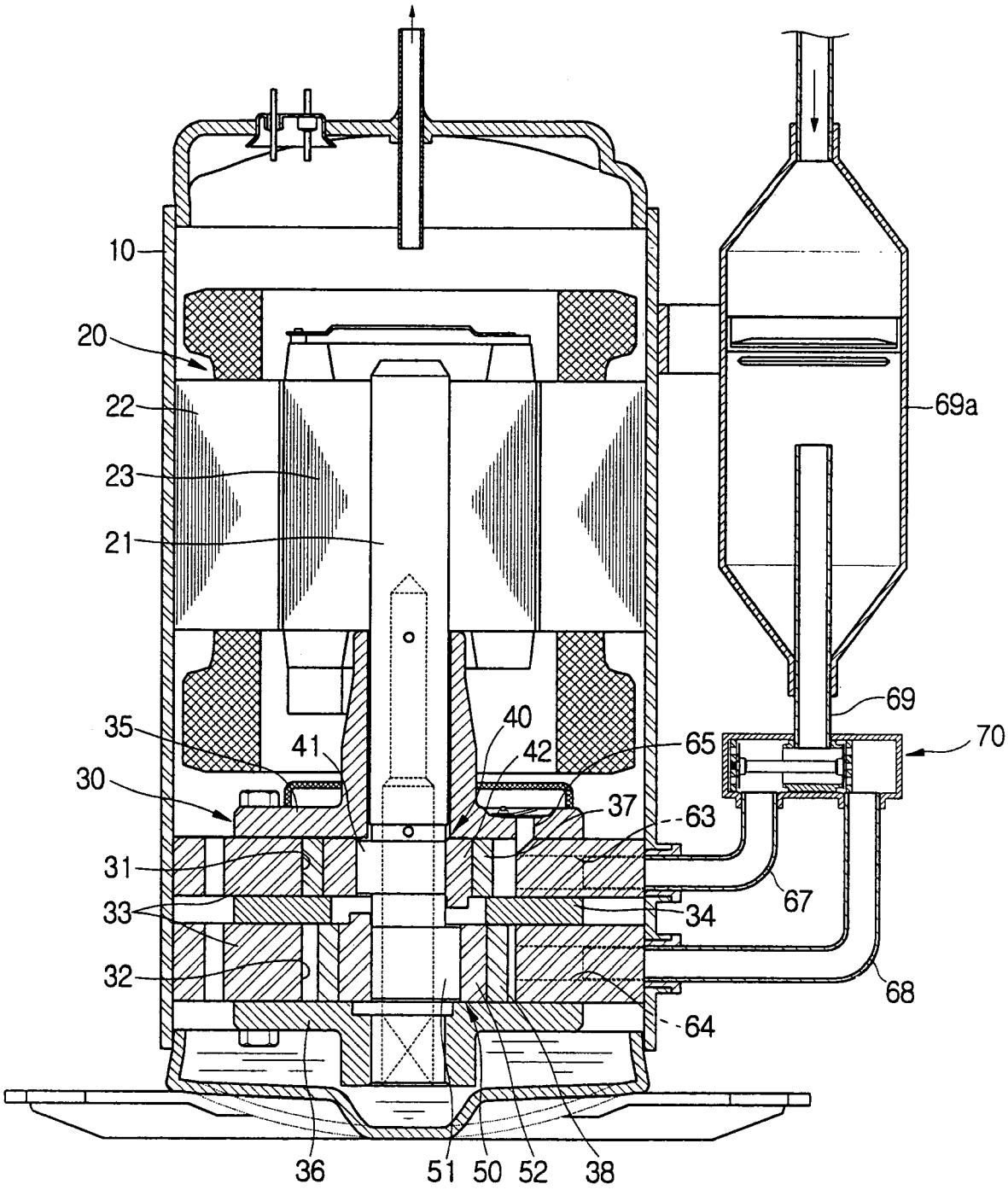
FIG. 1 is a sectional view of a variable capacity rotary compressor, according to a first embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

As illustrated in FIG. 1, a variable capacity rotary compressor according to the present invention includes a hermetic casing 10, with a drive unit 20 and a compressing unit 30 installed in the casing 10. The drive unit 20 generates a rotating force. The compressing unit 30 is connected to the drive unit 20 through a rotating shaft 21.

The drive unit 20 includes a cylindrical stator 22 and a rotor 23. The stator 22 is mounted to an inner surface of the casing 10. The rotor 23 is rotatably and concentrically set in the stator 22, and is mounted to the rotating shaft 21. The drive unit 20 rotates the rotating shaft 21 in opposite directions.

The compressing unit 30 includes a housing 33. Cylindrical first and second compression chambers 31 and 32, having different capacities, are provided on upper and lower portions of the housing 33, respectively. The housing 33 has two flanges 35 and 36, and a partition plate 34. The flanges 35 and 36 close an upper portion of the first compression chamber 31 and a lower portion of the second compression chamber 32, and rotatably support the rotating shaft 21. The partition plate 34 is interposed between the first and second compression chambers 31 and 32 so that the first and second compression chambers 31 and 32 are partitioned from each other.

Figure 2:
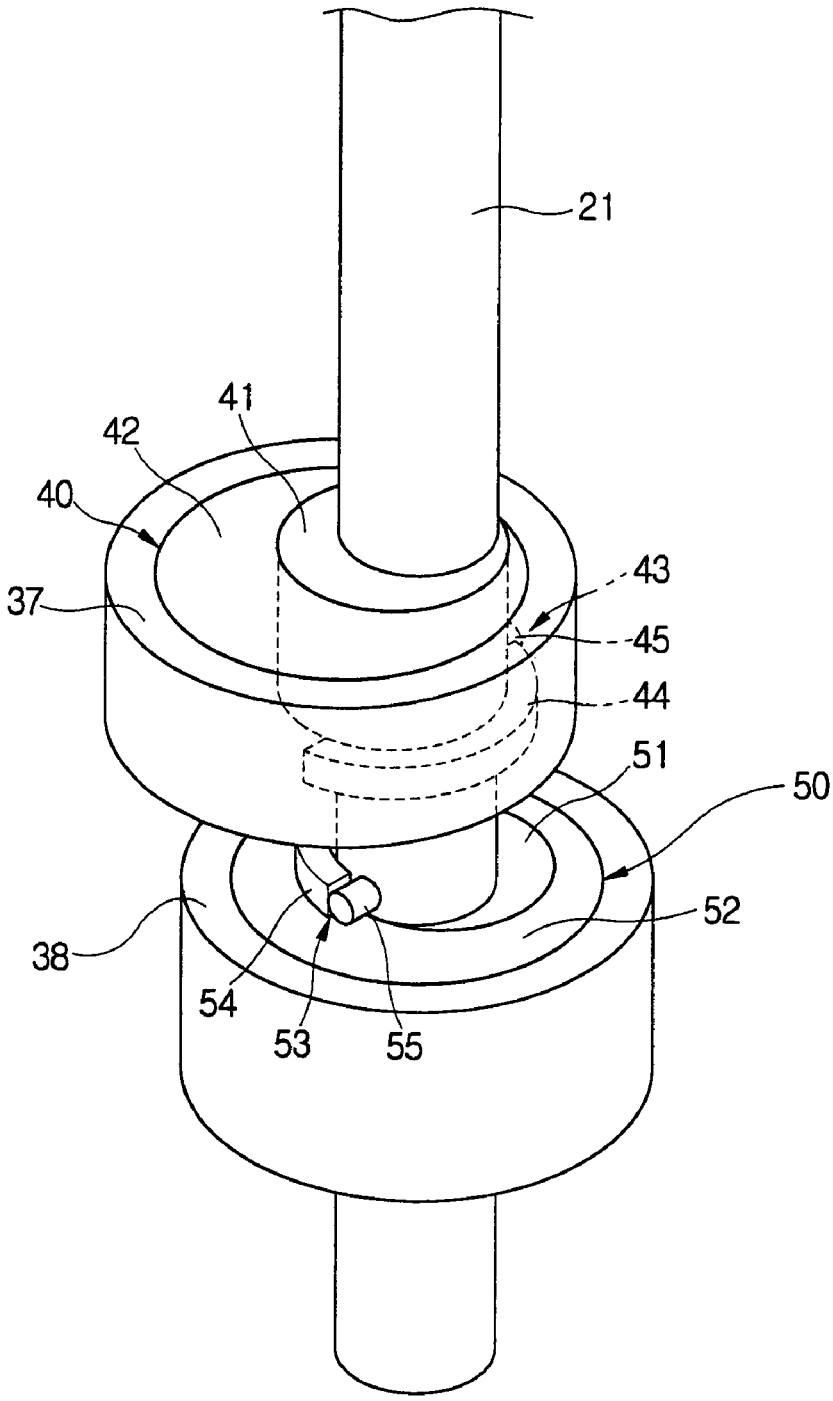
FIG. 2 is a perspective view of an eccentric unit included in the variable capacity rotary compressor, according to the first embodiment of the present invention.
Figure 3:
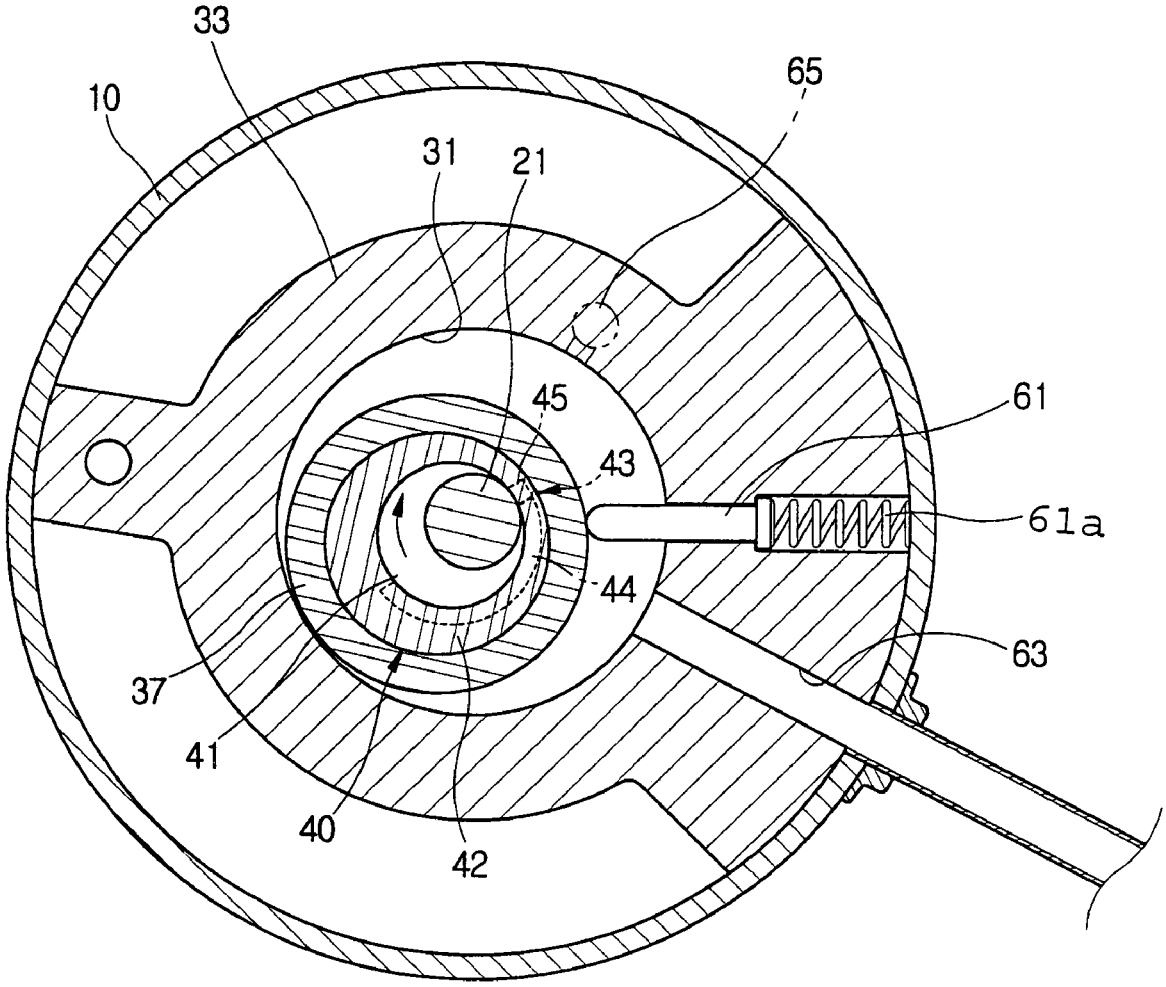
FIG. 3 is a sectional view illustrating a compression operation of a first compression chamber, when a rotating shaft of the variable capacity rotary compressor according to the first embodiment of the present invention is rotated in a forward direction.
Figure 4:
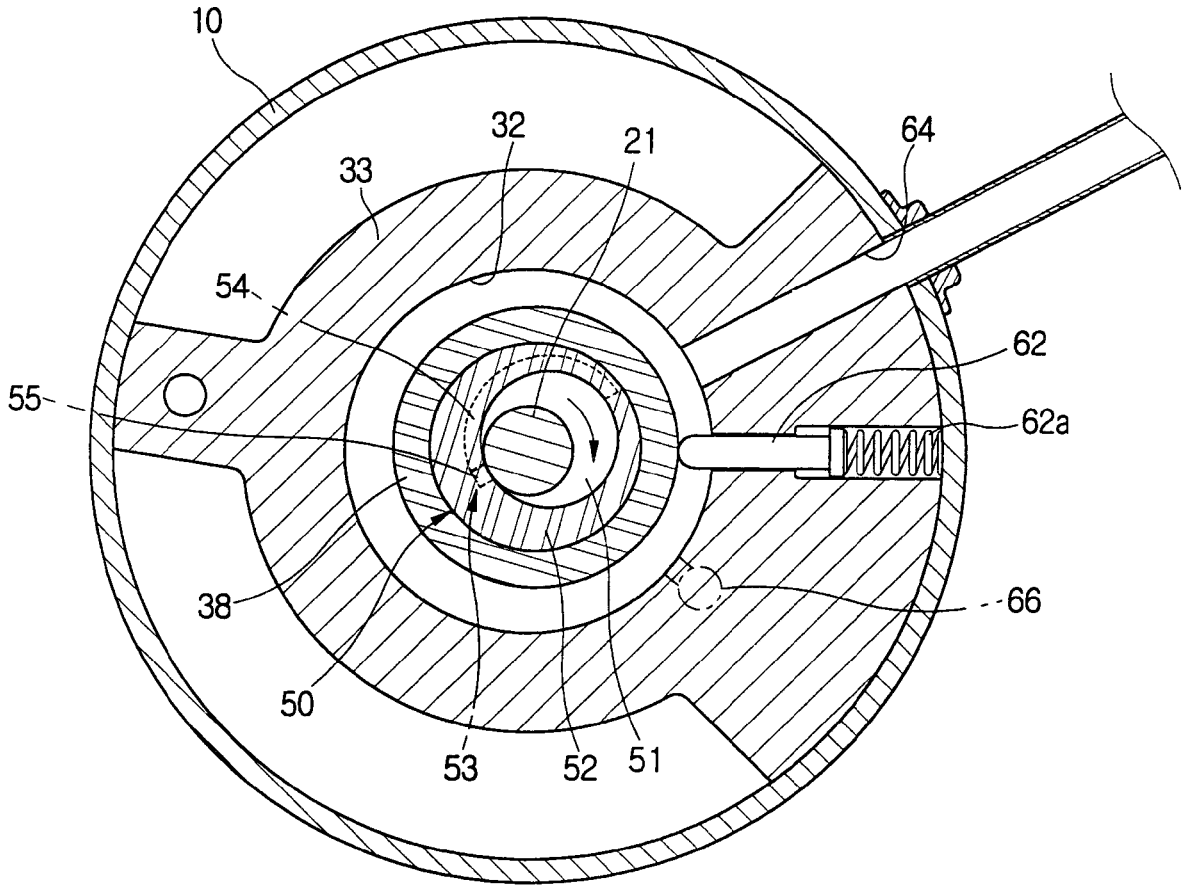
FIG. 4 is a sectional view illustrating an idle operation of a second compression chamber, when the rotating shaft of the variable capacity rotary compressor according to the first embodiment of the present invention is rotated in the forward direction.

As illustrated in FIGS. 2 to 4, the rotating shaft 21, installed in the first and second compression chamber 31 and 32, is provided with first and second eccentric units 40 and 50 which are arranged on opposite sides of the rotating shaft 21. First and second roller pistons 37 and 38 are rotatably fitted over the eccentric units 40 and 50, respectively. A first vane 61 is installed between an inlet port 63 and an outlet port 65 of the first compression chamber 31, and reciprocates in a radial direction while being in contact with an outer surface of the roller piston 37, thus performing a compression operation. Further, a second vane 62 is installed between an inlet port 64 and an outlet port 66 of the second compression chamber 32, and reciprocates in a radial direction while being in contact with an outer surface of the roller piston 38, thus performing a compression operation. The first and second vanes 61 and 62 are biased by vane springs 61*a* and 62*a*, respectively. Further, the inlet ports 63 and 64 of the two compression chambers 31 and 32 are opposite to the outlet ports 65 and 66 with respect to the vanes 61 and 62, respectively.

The first eccentric unit 40 includes a first eccentric cam 41 and a first eccentric bush 42, while the second eccentric unit 50 includes a second eccentric cam 51 and a second eccentric bush 52. The first and second eccentric cams 41 and 51 are fitted over the rotating shaft 21 in opposite directions in the first and second compression chambers 31 and 32, respectively. Further, the first and second eccentric bushes 42 and 52 are rotatably fitted over the first and second eccentric cams 41 and 51, respectively. The roller pistons 37 and 38 are rotatably fitted over the first and second eccentric bushes 42 and 52, respectively.

The eccentric units 40 and 50 are provided with locking units 43 and 53, respectively, so that the eccentric bushes 42 and 52 are rotated eccentrically from the rotating shaft 21 or rotated concentrically with the rotating shaft 21, according to a rotating direction of the rotating shaft 21. The locking unit 43, 53 is provided with a first locking part 45, 55 and a second locking part 44, 54. The first locking parts 45 and 55 are projected from the rotating shaft 21 or the eccentric cams 41 and 51, respectively. The second locking part 44, 54, having a semi-circular cross-section, is projected from a surface of the eccentric bush 42, 52 so as to be stopped by the first locking part 45, 55. In this case, the locking unit 43 of the first eccentric unit 40 and the locking unit 53 of the second eccentric unit 50 are arranged in opposite directions, so that when one of the eccentric units 40 and 50 is positioned eccentrically from the rotating shaft 21 by a rotation of the rotating shaft 21, the other eccentric unit 40, 50 is positioned concentrically with the rotating shaft 21.

Thus, as illustrated in FIG. 3, when the rotating shaft 21 is rotated clockwise (forward rotation), the first eccentric bush 42 of the first compression chamber 31 is positioned eccentrically from the rotating shaft 21, and is rotated along with the rotating shaft 21 by an engagement of the first locking part 45 of the rotating shaft 21 with the second locking part 44 of the first eccentric bush 42, thus performing a compression operation. FIG. 4 illustrates the second compression chamber 32 when the rotating shaft 21 is rotated clockwise. At this time, the outer surface of the second eccentric bush 52 is positioned concentrically with the rotating shaft 21, and is rotated along with the second eccentric cam 51 by the locking unit 53, thus performing an idle rotation.

Figure 5:
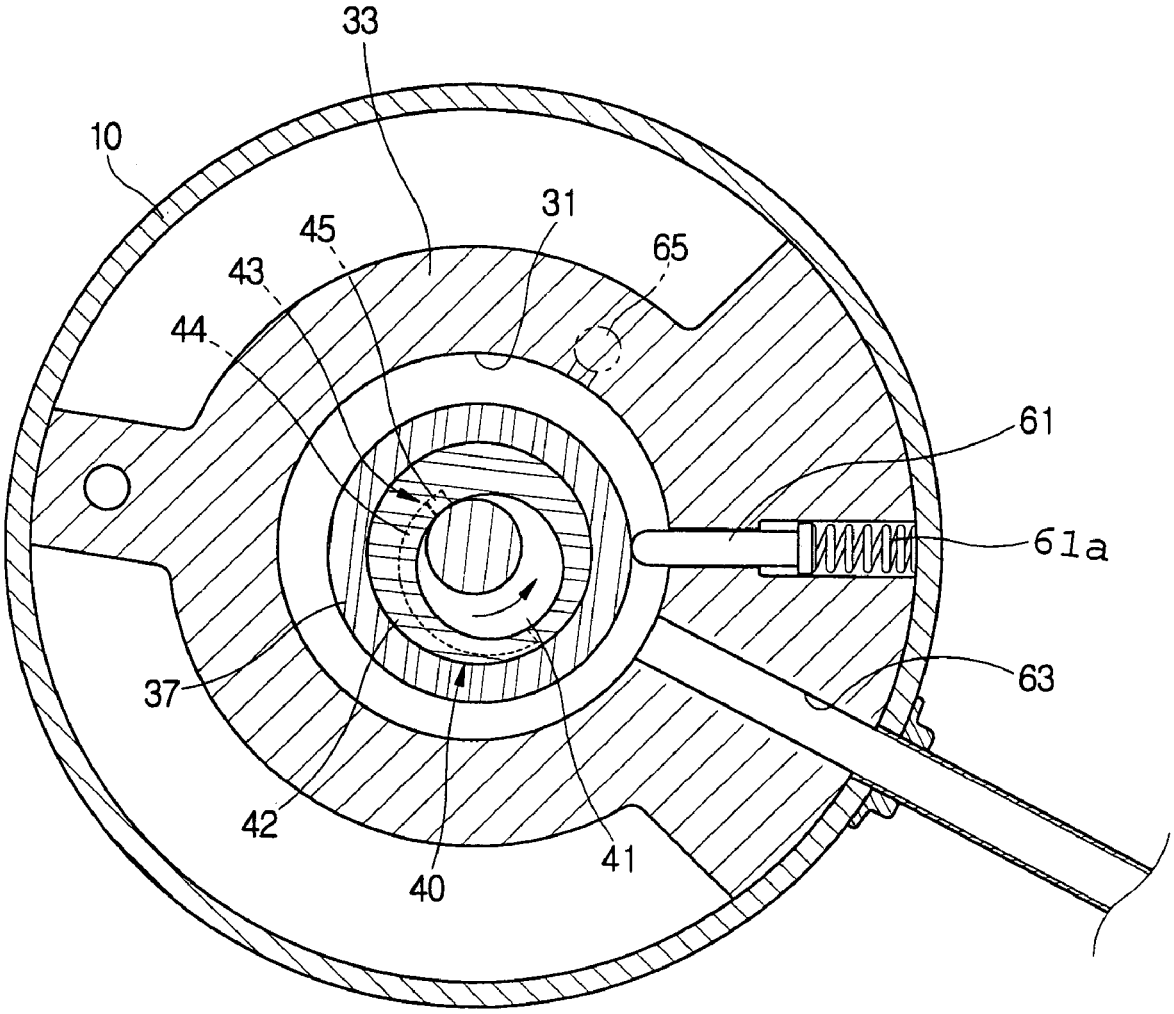
FIG. 5 is a sectional view illustrating an idle operation of the first compression chamber, when the rotating shaft of the variable capacity rotary compressor according to the first embodiment of the present invention is rotated in a reverse direction.
Figure 6:
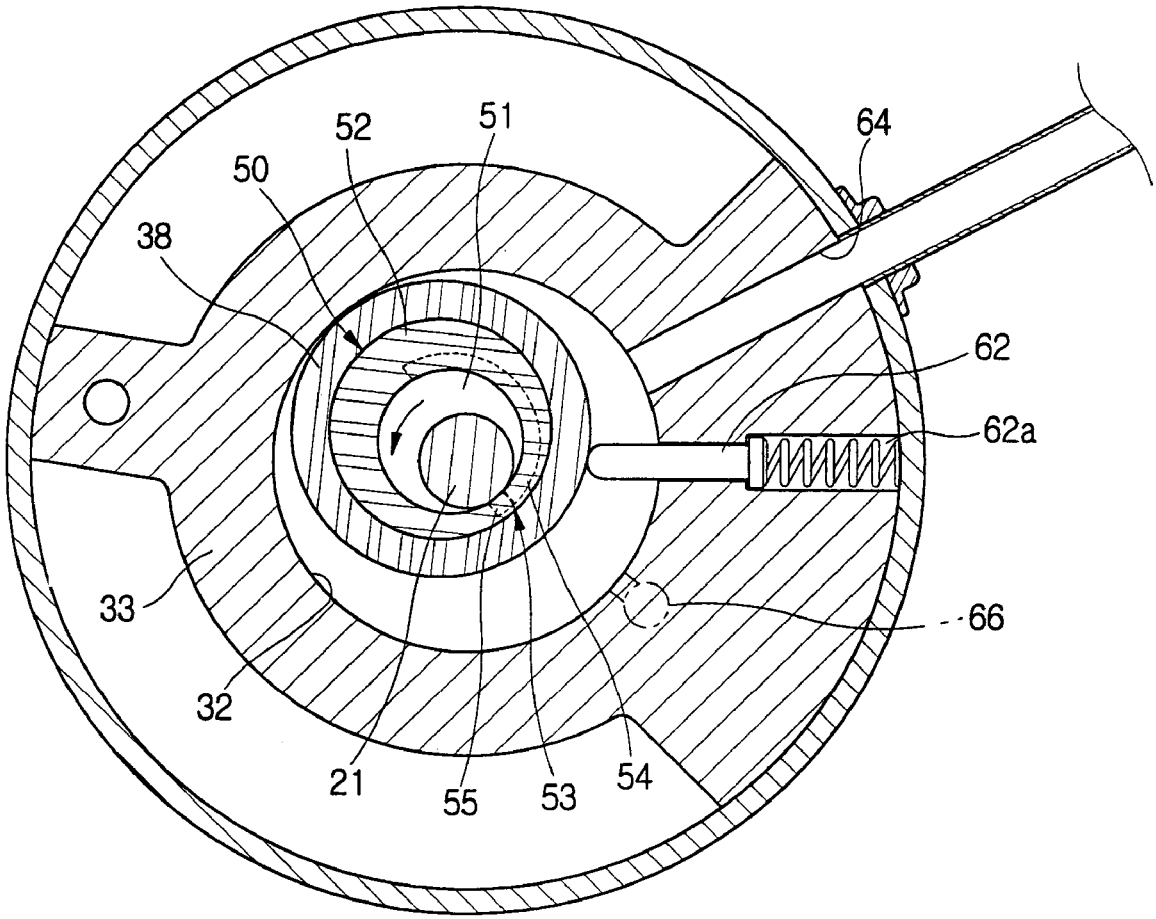
FIG. 6 is a sectional view illustrating a compression operation of the second compression chamber, when the rotating shaft of the variable capacity rotary compressor according to the first embodiment of the present invention is rotated in the reverse direction.

Meanwhile, FIGS. 5 and 6 illustrate the operation of the first and second compression chambers 31 and 32 when the rotating shaft 21 is rotated counterclockwise (reverse rotation). When the rotating shaft 21 is rotated counterclockwise, the first eccentric bush 42 of the first compression chamber 31 is positioned concentrically with the rotating shaft 21, so the compression operation is not performed in the first compression chamber 31. However, the second eccentric bush 52 of the second compression chamber 32 is positioned eccentrically with the rotating shaft 21, and is rotated along with the second eccentric cam 51, so the compression operation is performed in the second compression chamber 32.

According to the present invention, since the first and second eccentric units 40 and 50 are operated oppositely to each other when the rotating direction of the rotating shaft 21 is changed, the compression operation is performed in only one of the compression chambers 31 and 32. The compression chambers 31 and 32 have different interior capacities, thus allowing a compression capacity to be varied by only changing the rotating direction of the rotating shaft 21, and easily varying the compression capacity to obtain a desired exhaust pressure.

As illustrated in FIG. 1, the variable capacity rotary compressor according to the present invention also includes a path control unit 70. The path control unit 70 controls a refrigerant suction path so that a refrigerant fed from an accumulator 69*a* to a refrigerant inlet pipe 69 is delivered into either the inlet port 63 of the first compression chamber 31 or the inlet port 64 of the second compression chamber 32 . Therefore, the refrigerant is delivered into the inlet port of the compression chamber which performs the compression operation.

Figure 7:
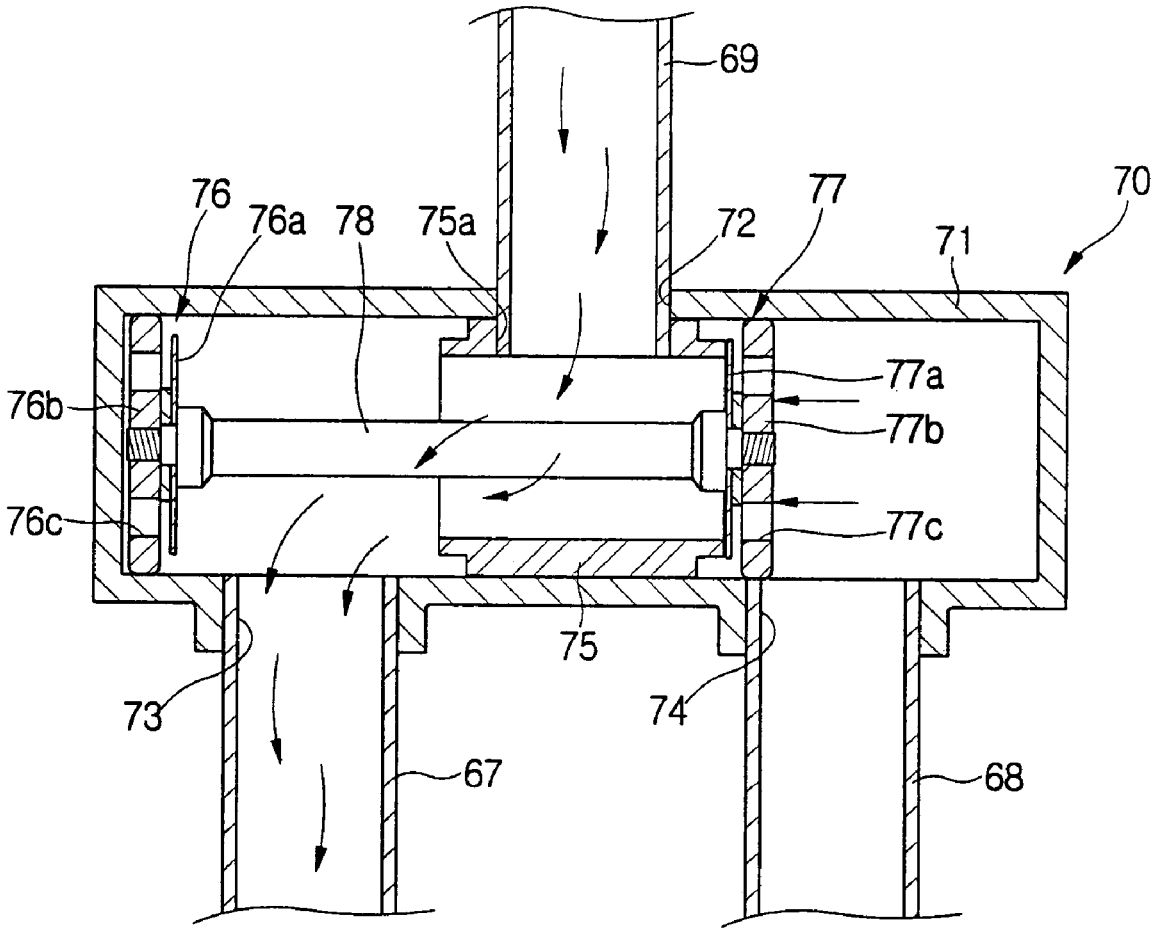
FIG. 7 is a sectional view of a path control unit of the variable capacity rotary compressor according to the first embodiment of the present invention, when a first outlet is open.
Figure 8:
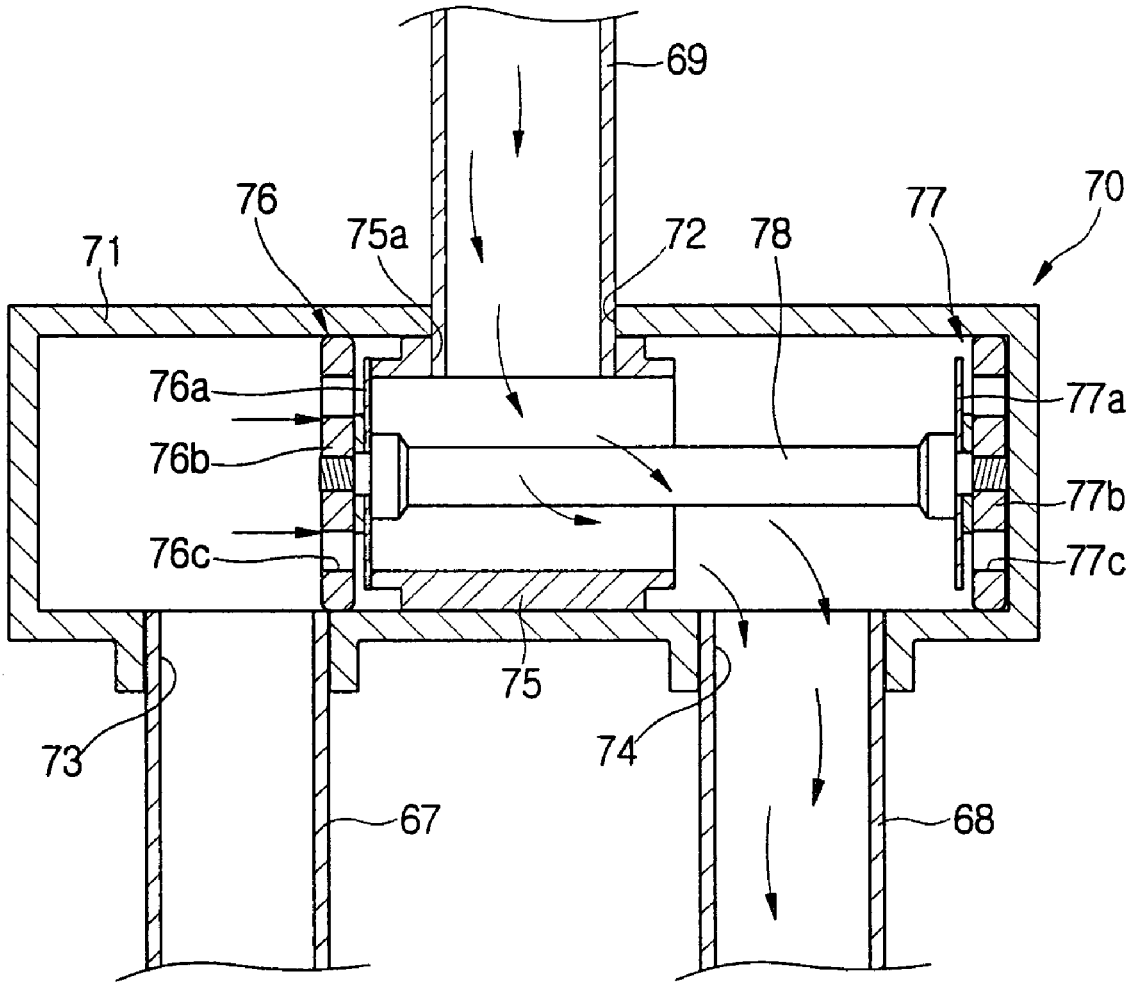
FIG. 8 is a sectional view of the path control unit of the variable capacity rotary compressor according to the first embodiment of the present invention, when a second outlet is open.
Figure 9:
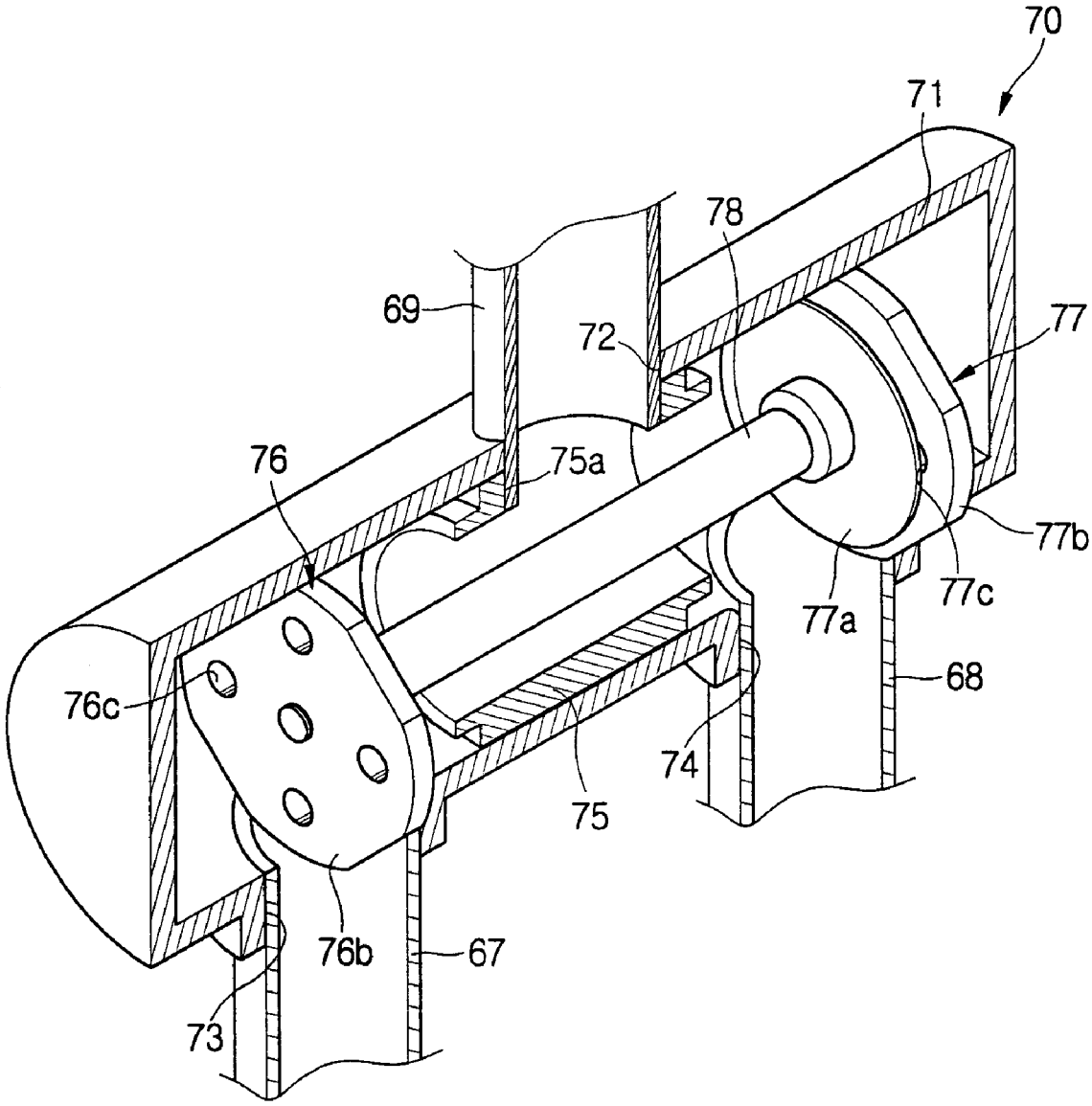
FIG. 9 is a perspective view of the path control unit of the variable capacity rotary compressor, according to the first embodiment of the present invention.

As illustrated in FIGS. 7 to 9, the path control unit 70 includes a hollow body 71. The body 71 has a cylindrical shape of a predetermined length, and is closed at both ends thereof. An inlet 72 is formed at a central portion of the body 71 to be connected to the refrigerant inlet pipe 69. First and second outlets 73 and 74 are formed on the body 71 at opposite sides of the inlet 72 in such a way as to be spaced apart from each other. Two pipes 67 and 68, which are connected to the inlet port 63 of the first compression chamber 31 and the inlet port 64 of the second compression chamber 32, respectively, are connected to the first and second outlets 73 and 74, respectively.

Further, the path control unit 70 includes a valve seat 75, first and second valve units 76 and 77, and a connecting member 78. The valve seat 75 has a cylindrical shape which is opened at both ends thereof, and is provided in the body 71 so as to form a step on an internal surface of the body 71. The first and second valve units 76 and 77 are provided at both sides in the body 71, and axially reciprocate in the body 71 to open or close the both ends of the valve seat 75. The connecting member 78 connects the first and second valve units 76 and 77 to each other so that the first and second valve units 76 and 77 move together. Further, the valve seat 75 has an opening 75*a* on a sidewall thereof to allow an interior space thereof to communicate with the inlet 72. The valve seat 75 has a length which is shorter than a distance between the two outlets 73 and 74, and is fitted into the body 71.

The first and second valve units 76 and 77 are mounted to both ends of the connecting member 78, respectively. The first valve unit 76 includes a thin valve plate 76*a* and a support member 76*b*, and the second valve unit 77 includes a thin valve plate 77*a* and a support member 77*b*. Each of the valve plates 76*a* and 77*a* comes into contact with the valve seat 75 so as to close a refrigerant path. The support members 76*b* and 77*b* are mounted to both ends of the connecting member 78 to movably support the valve plates 76*a* and 77*a* in the body 71, respectively. In this case, each of the support members 76*b* and 77*b* has an outer diameter corresponding to an inner diameter of the body 71 so as to smoothly reciprocate in the body 71. A plurality of holes 76*c* and 77*c* are formed on the support members 76*b* and 77*b*, respectively, to allow air ventilation.

The path control unit 70 is operated as follows. As illustrated in FIG. 7, when the compression operation is performed in the first compression chamber 31, the two valve units 76 and 77, which are connected to each other via the connecting member 78, move in a direction toward the first outlet 73 by a suction force applied to the first outlet 73, so that the refrigerant is sucked into the first outlet 73. At this time, since the valve plate 77*a* of the second valve unit 77 closes the end of the valve seat 75 which communicates with the second outlet 74, a path where the refrigerant is sucked into the second outlet 74 is closed. Further, in this case, the second compression chamber 32 performs the idle operation, so a pressure of the second compression chamber 32 is increased due to the concentric position of the second eccentric unit 50. At this time, since the pressure of the second compression chamber 32 is transmitted to the second outlet 74 of the path control unit 70, the two valve units 76 and 77 move more smoothly in a direction toward the first outlet 73.

Conversely, when the compression operation is performed in the second compression chamber 32, as illustrated in FIG. 8, the two valve units 76 and 77, which are connected to each other via the connecting member 78, move in a direction toward the second outlet 74 by a suction force applied to the second outlet 74, so that the refrigerant is sucked into the second outlet 74. Further, in this case, the first compression chamber 31 performs the idle operation, so a pressure of the first compression chamber 31 is increased due to the concentric position of the first eccentric unit 40. At this time, since the increased pressure of the first compression chamber 31 is transmitted to the first outlet 73 of the path control unit 70, the two valve units 76 and 77 move more smoothly in a direction toward the second outlet 74.

As such, according to the present invention, the two valve units 76 and 77 provided in the body 71 move in a direction toward the one of the two outlets 73 and 74 having a lower pressure due to a difference in pressure between the two outlets 73 and 74, thus closing one of the ends of the valve seat 75. That is, according to the present invention, the refrigerant suction path is automatically changed so that the inlet 72 of the path control unit 70 communicates with the one of the two outlets 73 and 74 having a lower pressure, thus allowing the refrigerant suction path to be easily changed without an additional drive unit.

Figure 10:
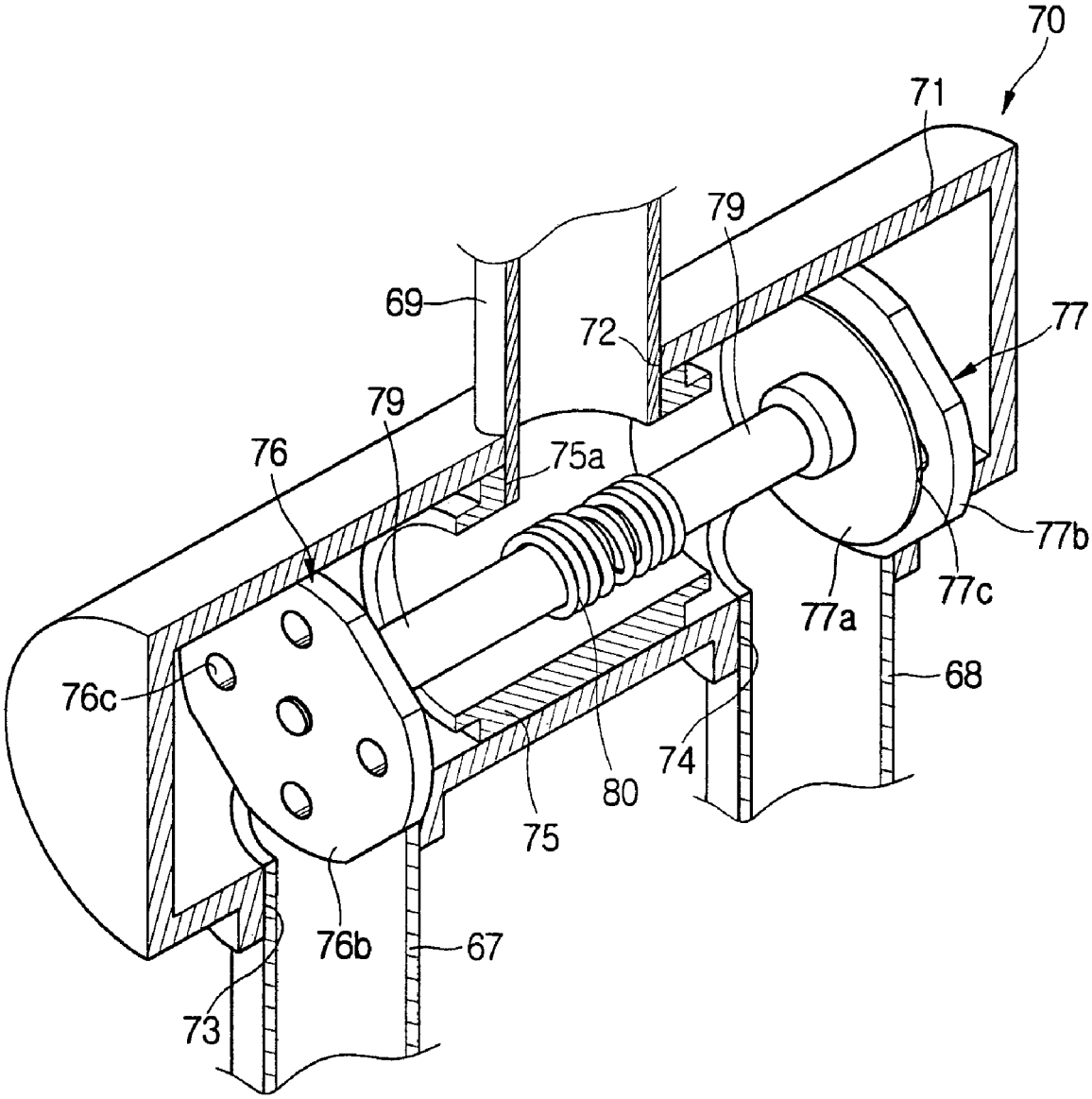
FIG. 10 is a perspective view of a path control unit, according to a second embodiment of the present invention.

FIG. 10 illustrates a path control unit 70, according to a second embodiment of the present invention. According to the second embodiment, a connecting member 79 connecting the two valve units 76 and 77 to each other comprises two parts. The two parts of the connecting member 79 are connected to each other by an elastic member 80, such as a coil spring, so any shock and vibration which are generated during reciprocating movements of the valve units 76 and 77 are absorbed by the elastic member 80. In this case, the elastic member 80 is made of rubber having elasticity.

As is apparent from the above description, the present invention provides a variable capacity rotary compressor, which is designed such that a compression operation is selectively performed in one of two compression chambers having different capacities, according to a rotating direction of a rotating shaft, thus precisely varying a compression capacity to obtain a desired exhaust pressure, and easily controlling the compression capacity of the rotary compressor.

Further, the present invention provides a variable capacity rotary compressor, which is designed such that a refrigerant suction path is automatically changed so that a refrigerant is sucked into one of two compression chambers which performs a compression operation, thus having a high compressing efficiency.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A variable capacity rotary compressor, comprising:

a housing comprising two compression chambers, the two compression chambers having different capacities;

a rotating shaft rotatably provided in the two compression chambers;

two eccentric units respectively provided in the compression chambers so as to be fitted over the rotating shaft, the two eccentric units being operated so that one of the two eccentric units is positioned eccentrically from the rotating shaft to perform a compression operation while the other eccentric unit is positioned concentrically with the rotating shaft to perform an idle operation, according to a rotating direction of the rotating shaft;

roller pistons fitted over each of the two eccentric units;

vanes installed in each of the two compression chambers so as to reciprocate in a radial direction while being in contact with an outer surface of the roller piston; and a path control unit to control a refrigerant suction path so that a refrigerant is provided to an inlet port of one of the two compression chambers which performs the compression operation.

2. The variable capacity rotary compressor according to claim 1, wherein the path control unit comprises:

a hollow body having a predetermined length, and being closed at both ends thereof;

a refrigerant inlet member;

an inlet formed at a central portion of the hollow body, and coupled to the refrigerant inlet member;

first and second outlets respectively formed on the hollow body at opposite sides of the inlet, and coupled to the inlet ports of the two compression chambers;

a valve seat provided in the hollow body so as to form a decrease in the cross-sectional area of the hollow body, the valve seat having an opening on a sidewall thereof to allow an interior space thereof to communicate with the inlet and being opened at both ends thereof to communicate with the outlets; and first and second valve units respectively provided at each end of the valve seat.

3. The variable capacity rotary compressor according to claim 2, wherein the valve seat has a length shorter than a distance between the two outlets, the valve seat being fitted into the hollow body so that the opening formed on the sidewall of the valve seat communicates with the inlet of the path control unit.

4. The variable capacity rotary compressor according to claim 3, further comprising a connecting member, wherein the first and second valve units are coupled to each other by the connecting member so as to be moved together.

5. The variable capacity rotary compressor according to claim 4, wherein the first and second valve units are axially reciprocating in the hollow body to open and close each end of the valve seat.

6. The variable capacity rotary compressor according to claim 5, wherein each of the first and second valve units comprises a thin valve plate able to come into contact with the valve seat.

7. The variable capacity rotary compressor according to claim 6, wherein each of the first and second valve units further comprises a support member to movably support the valve plate in the hollow body.

8. The variable capacity rotary compressor according to claim 7, wherein each support member has an outer diameter corresponding to an inner diameter of the hollow body so as to smoothly reciprocate in the body.

9. The variable capacity rotary compressor according to claim 8, wherein a plurality of holes are formed on the support member.

10. The variable capacity rotary compressor according to claim 4, wherein the first and second valve units move in a direction toward one of the two outlets having a lower pressure due to a difference in pressure between the two outlets, thus closing one of the both ends of the valve seat so that the inlet communicates with the outlet having the lower pressure.

11. The variable capacity rotary compressor according to claim 4, wherein the connecting member comprises at least two parts, the at least two parts of the connecting member being connected to each other by an elastic member to absorb shock.

12. The variable capacity rotary compressor according to claim 11, wherein the elastic member is made of a rubber having elasticity.

* * * * *

UNITED STATES PATENT AND TRADEMARK OFFICE

CERTIFICATE OF CORRECTION

PATENT NO. : 7,293,966 B2
APPLICATION NO. : 10/648244
DATED : November 13, 2007
INVENTOR(S) : Sung-Hea Cho et al.

It is certified that error appears in the above-identified patent and that said Letters Patent is hereby corrected as shown below:

First Page, Column 2 (Abstract), Line 17, change “refrigeran” to --refrigerant--.

Signed and Sealed this

Twenty-ninth Day of April, 2008

JON W. DUDAS
*Director of the United States Patent and Trademark Office*